US012383800B2

(12) United States Patent
Vergara

(10) Patent No.: US 12,383,800 B2
(45) Date of Patent: Aug. 12, 2025

(54) GOLF BALL RETRIEVER

(71) Applicant: SSG International, LLC, Wixom, MI (US)

(72) Inventor: David Vergara, White Lake, MI (US)

(73) Assignee: SSG INTERNATIONAL, LLC, Wixom, MI (US)

( * ) Notice: Subject to any disclaimer, the term of this patent is extended or adjusted under 35 U.S.C. 154(b) by 595 days.

(21) Appl. No.: 17/900,381

(22) Filed: Aug. 31, 2022

(65) Prior Publication Data

US 2024/0066361 A1 Feb. 29, 2024

(51) Int. Cl.
*A63B 47/02* (2006.01)
*A63B 60/00* (2015.01)
*A63B 102/32* (2015.01)

(52) U.S. Cl.
CPC ..... *A63B 47/02* (2013.01); *A63B 60/00* (2015.10); *A63B 2102/32* (2015.10)

(58) Field of Classification Search
CPC ..... A63B 47/02
See application file for complete search history.

(56) References Cited

U.S. PATENT DOCUMENTS 5,460,366 A 10/1995 Pugh
7,951,014 B2 5/2011 Nickel
8,523,699 B2 9/2013 Bennett
9,463,363 B2 10/2016 Dingman et al.
9,968,835 B2 5/2018 Suwito
2002/0169030 A1 11/2002 Chun-Sheng
2007/0259731 A1 11/2007 Barouh
2009/0149270 A1* 6/2009 Nickel ..... A63B 47/02 473/286
2011/0053701 A1 3/2011 Eddings
2012/0289355 A1 11/2012 Bennett
2016/0074722 A1 3/2016 Rogers et al.

FOREIGN PATENT DOCUMENTS

JP 2021164588 A 10/2021

OTHER PUBLICATIONS

"Vanknono Golf Ball Pick Up Retriever Grabber" found at https://a.co/d/4yMFW8n (accessed Aug. 31, 2022).

* cited by examiner

*Primary Examiner* — Sean P Gramling
(74) *Attorney, Agent, or Firm* — WARNER NORCROSS + JUDD LLP

(57) ABSTRACT

A golf ball retriever adapted to be removably affixed to a putter grip is provided. A grip cap secures the golf ball retriever to an internally threaded port in the putter grip, which functions as a point of attachment for counter weights and other accessories. The golf ball retriever includes folding arms that are movable from a stowed position to a deployed position, forming a claw-like pocket for grasping a golf ball. The folding arms can be manually manipulated from the deployed position to the stowed position for conventional use of the putter or when returning the putter to a golf bag.

21 Claims, 10 Drawing Sheets

GOLF BALL RETRIEVER

FIELD OF THE INVENTION

The present invention relates to a golf ball retriever that can be removably installed to the butt end of a golf club grip to facilitate retrieval of a golf ball.

BACKGROUND OF THE INVENTION

The prior art provides a variety of golf ball retrievers for recovering a golf ball from difficult-to-reach places, such as water hazards, dense foliage, bunkers, and mud or wet soil. For example, existing standalone golf ball retrievers often include a telescopic handle and a retriever head. The retriever head can include a spring-loaded grip or can include a rubberized pocket to grip and hold the golf ball in place. Other golf ball retrievers are attached directly to the butt end of a putter grip, such that the putter shaft functions as an elongated handle. These golf ball retrievers are typically affixed to a putter grip using a machine screw or are affixed to a putter grip using a barbed fastener that is received within the vent port of the putter grip. Despite their general availability in the marketplace, however, there remains a continued need for an improved golf ball retriever. In particular, there remains a continued need for an improved golf ball retriever that can be readily attached to and removed from a putter grip without damaging the putter grip.

SUMMARY OF THE INVENTION

A golf ball retriever adapted to be removably affixed to a putter grip is provided. A grip cap secures the golf ball retriever to an internally threaded port in the putter grip, which functions as a point of attachment for counter weights and other accessories. The golf ball retriever includes folding arms that are movable from a stowed position to a deployed position, forming a claw-like pocket for grasping a golf ball. The folding arms can be manually manipulated from the deployed position to the stowed position for conventional use of the putter or when returning the putter to a golf bag for later use on a putting green.

In one embodiment, the first folding arm is generally U-shaped with two arm segments that extend toward the second folding arm. The second folding arm includes a single arm segment that is positioned between the two arm segments of the first folding arm. The arm segments of the first folding arm are magnetically and/or mechanically secured to a base when in the stowed position. The second folding arm is biased in the deployed position by a hinge spring and includes lateral protrusions that underlie the first folding arm when both folding arms are in the stowed position. In this respect, the first folding arm maintains the second folding arm in the stowed position, preventing the second folding arm from springing into the deployed position.

In another embodiment, the base includes an outer diameter that generally corresponds to the outer diameter of a putter grip, such that the base appears as an extension of the putter grip. The base includes first and second magnets for magnetically attracting the ferromagnetic elements in the arm segments of the first folding arm. The base also includes a central aperture in alignment with the threaded port of a putter grip. The grip cap is inserted through the central aperture and threaded into the threaded port for clamping the base to the putter grip.

To recover a golf ball, a user presses a cantilevered edge of the first folding arm or grips a concave recess on each side of the first folding arm to pivot the first folding arm to an upright position. Once the first folding arm rotates free of the second folding arm, the second folding arm springs upright by action of the torsion spring. In this fully deployed position, each folding arm is at its maximum range of motion, thereby forming a claw-like pocket. The user can then invert the putter and lower the golf ball retriever onto the golf ball, causing the folding arms to deflect slightly around the golf ball until the folding arms mechanically grasp the golf ball. Once the golf ball is secured in the pocket of the golf ball retriever, the user can return the golf club to the upright position and recover the golf ball. The folding arms can be returned to the stowed position and the putter can be returned to a golf bag or used in the normal course of play.

These and other features of the invention will be more fully understood and appreciated by reference to the description of the embodiments and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. In addition, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE CURRENT EMBODIMENTS

The current embodiments include a golf ball retriever adapted to be removably affixed to a threaded port in a putter grip to allow a golf ball to be easily retrieved from difficult to reach areas. The threaded port provides a threaded opening for counter weights and other accessories, and also provides a point of attachment for the golf ball retriever. The golf ball retriever includes folding arms that are movable from a stowed position to a deployed position, forming a claw-like pocket for grasping a golf ball. The golf ball retriever is discussed in Part I below, and its installation and operation are discussed in Part II below.

I. Golf Ball Retriever

Figure 1:
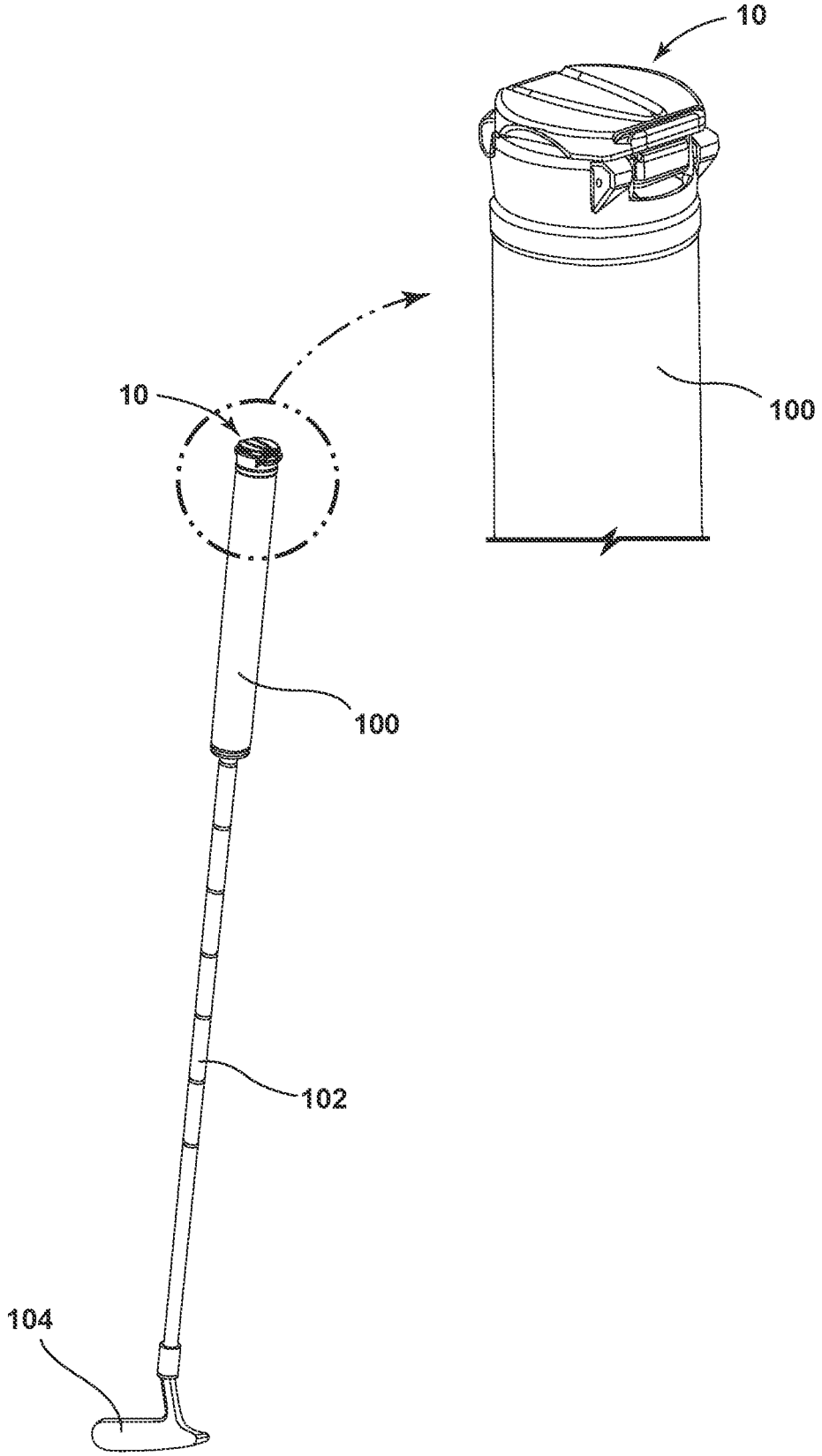
FIG. 1 is a perspective view of a golf ball retriever joined to a putter grip.
Figure 2:
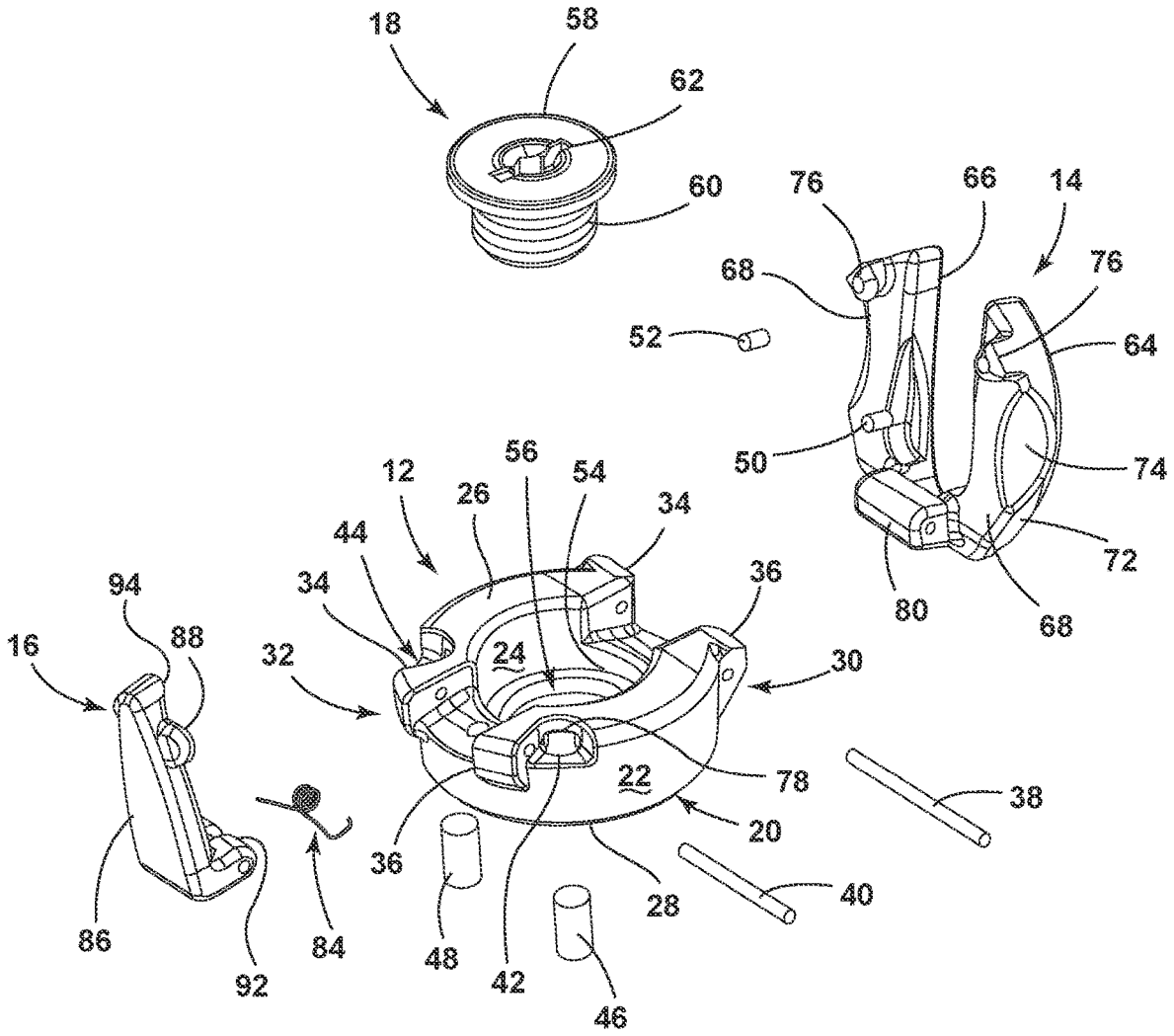
FIG. 2 is an exploded view of the golf ball retriever of FIG. 1.

Referring first to FIGS. 1-2, a golf ball retriever 10 in accordance with an exemplary embodiment is illustrated and generally designated 10. The golf ball retriever 10 includes a base 12, a first folding arm 14, a second folding arm 16, and a grip cap 18. The grip cap 18 is adapted to secure the base 12 to a threaded port 102 comprising an internally threaded opening in the butt end of a putter grip 100, while the first and second folding arms 14, 16 cooperate to define a claw-like pocket for grasping a golf ball. Each such feature is separately described below.

The base 12 includes an outer profile that generally corresponds to the outer profile of the putter grip 100, such that the golf ball retriever 10 appears as an extension of the putter grip 100. The base 12 is generally cylindrical in the present embodiment, however in other embodiments the base 12 can include other geometries to match that of the putter grip 100, for example a polygonal cross-section, further optionally a quadrilateral cross-section or a pentagonal cross-section. The base 12 includes a sidewall 20, the sidewall 20 including an exterior side surface 22, an interior side surface 24, upper and lower surfaces 26, 28, and a first hinge portion 30 opposite of a second hinge portion 32. The first hinge portion 30 and the second hinge portion 32 each comprise first and second spaced-apart horns 34, 36 having openings for receiving a hinge pin. A first hinge pin 38 is received in the first hinge portion 30, forming a first hinge joint, and a second hinge pin 40 is received in the second hinge portion 32, forming a second hinge joint. The sidewall 20 also includes first and second recesses 42, 44 for first and second magnets 46, 48. The magnets 46, 48 are magnetically attracted to first and second ferromagnetic elements 50, 52 in the first folding arm 14. The base 12 also includes an annular flange 54 extending radially inward from the sidewall 20 at the lowermost portion thereof, such that the flange 54 defines a central aperture 56 extending through the base 12. The base 12 is formed from a molded glass-filled thermoplastic in the present embodiment, but can be manufactured from other materials in other embodiments.

As also shown in FIG. 2, the grip cap 18 includes a head 58 and a shank 60. The head 58 includes a tool opening 62, for example a six-sided opening for a hex tool or a four-sided opening for a flathead screwdriver. The shank 60 is externally threaded and is sized to pass through the central aperture 56 in the base 12 for threadably engaging the threaded port 102 in the putter grip 100. The head 58 includes an outer diameter that is greater than the inner diameter of the central aperture 56 but less than or equal to the inner diameter of the sidewall 20, such that the head 58 bears against the flange 54 to clamp the base 12 to the putter grip 100. The grip cap 18 comprises an aluminum screw head in the present embodiment, but can be formed from other materials in other embodiments, for example other metals, thermoplastics, or composite materials. Further optionally, the grip cap 18 can be as described in U.S. Pat. No. 9,463,363 to Dingman et al, the disclosure of which is incorporated by reference in its entirety. The grip cap 18 can include for example a threaded extension to threadably engage a weighted insert or other feature housed within the putter grip 100 when not being used to secure the base 12 to the putter grip 100.

As noted above, the golf ball retriever 10 includes first and second folding arms 14, 16 that are movable from a stowed position to a deployed position for grasping a golf ball. The first folding arm 14 is rotatably joined to the first hinge portion 30 and includes first and second spaced apart arm segments 64, 66, such that the first folding arm 14 is generally U-shaped. The first and second arm segments 64, 66 include a planar bottom surface 68, a planar upper surface 70, and a curved side surface 72 therebetween. The first and second arm segments 64, 66 also include a concave recess 74 interconnecting the curved side surface 72 and the planar bottom surface 68. As explained in Part II below, the concave recesses 74 provides a grasping point for manipulation of the first folding arm 14 from the stowed position to the deployed position.

To retain the first folding arm 14 in the stowed position, the first and second arm segments 64, 66 each include a retention latch 76. The retention latch 76 mechanically interfaces with a notch 78 in the outer radial surface of the sidewall 22 and houses respective first and second ferromagnetic elements 50, 52 (e.g., stainless steel or other corrosion resistant steel) that are magnetically attracted to the respective first and second magnets 46, 48. In other embodiments this configuration is reversed, such that the magnets 46, 48 are housed within the retention latches 76, while the ferromagnetic elements 50, 52 are housed within the base 12. In still other embodiments, two permanent magnets are used in place of the ferromagnetic elements 50, 52, the permanent magnets being oriented with the correct North-South polarity such that they are magnetically attracted to the first and second magnets 46, 48 in the base 12.

The first folding arm 14 also includes a channel 80 for receiving the first hinge pin 38. The channel 80 is interposed between the first and second horns 34, 36 of the first hinge portion 30. The first folding arm 14 can be opened by depressing a cantilevered edge 82, overcoming the magnetic attraction that otherwise retains the first folding arm 14 in the stowed position. The bottom surface 68 of the first folding arm 14 mechanically interferes with the first and second horns 34, 36 of the first hinge portion 30 to lock the first folding arm 14 in the deployed position. The outer-most portion of the first and second horns 34, 36 is outwardly inclined, such that the first folding arm 14 is oriented at greater than 90 degrees when in the deployed position (best shown in FIG. 9). For example, the first folding arm 14 can have a maximum range of motion of at least 90 degrees, further optionally 95 degrees to 130 degrees.

As noted above, the golf ball grip 10 also includes a second folding arm 16. The second folding arm 16 is held in the stowed position by the first folding arm 10 and is biased into the deployed position by a hinge spring 84. The second folding arm 16 includes a single arm segment 86 that is disposed in the gap between the arm segments 64, 66 of the first folding arm 14. The second folding arm 16 includes first and second lateral protrusions 88, 90 that underlie the first folding arm 14 when both folding arms 14, 16 are in the stowed position. In this respect, the first folding arm 14 maintains the second folding arm 16 in the stowed position, preventing the second folding arm 16 from springing into the deployed position by operation of the hinge spring 84. The second folding arm 16 terminates at a sloped projection 94 that curves inward for grasping a golf ball. The hinge spring 84 extends around the second hinge pin 40, which is received within a channel 92 that is interposed between the first and second horns 34, 36 of the second hinge portion 32. Like the first folding arm 14, the second folding arm 16 can have a maximum range of motion of at least 90 degrees, further optionally 95 degrees to 130 degrees. The second folding arm 16 is generally the same length as the first folding arm 14, such that the three arm segments 64, 66, 86 collectively comprise a three-finger claw for grasping a golf-ball from difficult-to-reach places. The first and second folding arms 14, 16 are formed from a glass-filed thermoplastic in the current embodiment, but can be formed from other materials in other embodiments.

While described above as having three arm segments, in other embodiments the folding arms 14, 16 provide a different number of arm segments. In one alternative embodiment, the first folding arm 14 is T-shaped and the second folding arm 16 is I-shaped, such that the folding arms comprise a two-finger claw for grasping a golf ball. In another alternative embodiment, both folding arms 14, 16 are U-shaped and are laterally offset from each other, such that the folding arms comprise a four-finger claw for grasping a golf ball. In still another alternative embodiment, the second folding arm 16 includes three arm segments, being generally W-shaped, such that a W-shaped folding arm 16 and a U-shaped folding arm 14 cooperate to provide a five-finger claw for grasping a golf ball. Still other configurations are possible in other embodiments.

While primarily described above in connection with a grip cap 18 to removably secure the base 12 to the putter grip 100, in alternative embodiments a grip cap 18 is omitted. In these alternative embodiments, the base 12 is instead removably secured to the putter grip 100 via double-sided tape, hook-and-loop fasteners, snap-fit connectors, or combinations thereof. Still other methods of attaching the base 12 to the putter grip 100 are possible in other embodiments.

II. Installation and Operation

Installation of the golf ball retriever 10 and its operation will now be described in connection with FIGS. 3-10. The first and second folding arms 14, 16 are moved to the deployed position by depressing the cantilevered edge 82 on the first folding arm 14. Alternatively, a user can grip the concave recess 74 on either side of the first folding arm 14 and pivot the first folding arm 14 to an upright position. Once the first folding arm 14 rotates past approximately 30 degrees, the second folding arm 16 springs upright in response to the spring force of the torsion spring 84. The first folding arm 14 mechanically interferes with the first hinge portion 30 to lock the first folding arm 14 in the fully deployed position.

Figure 3:
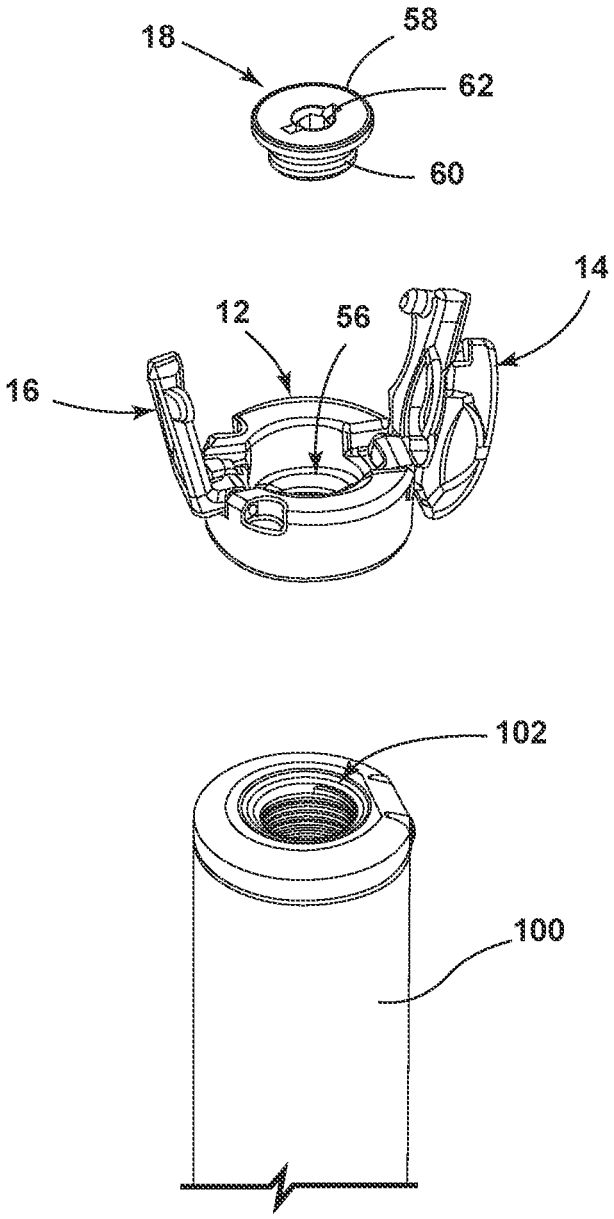
FIG. 3 depicts the golf ball retriever of FIG. 1 including a grip cap.
Figure 4:
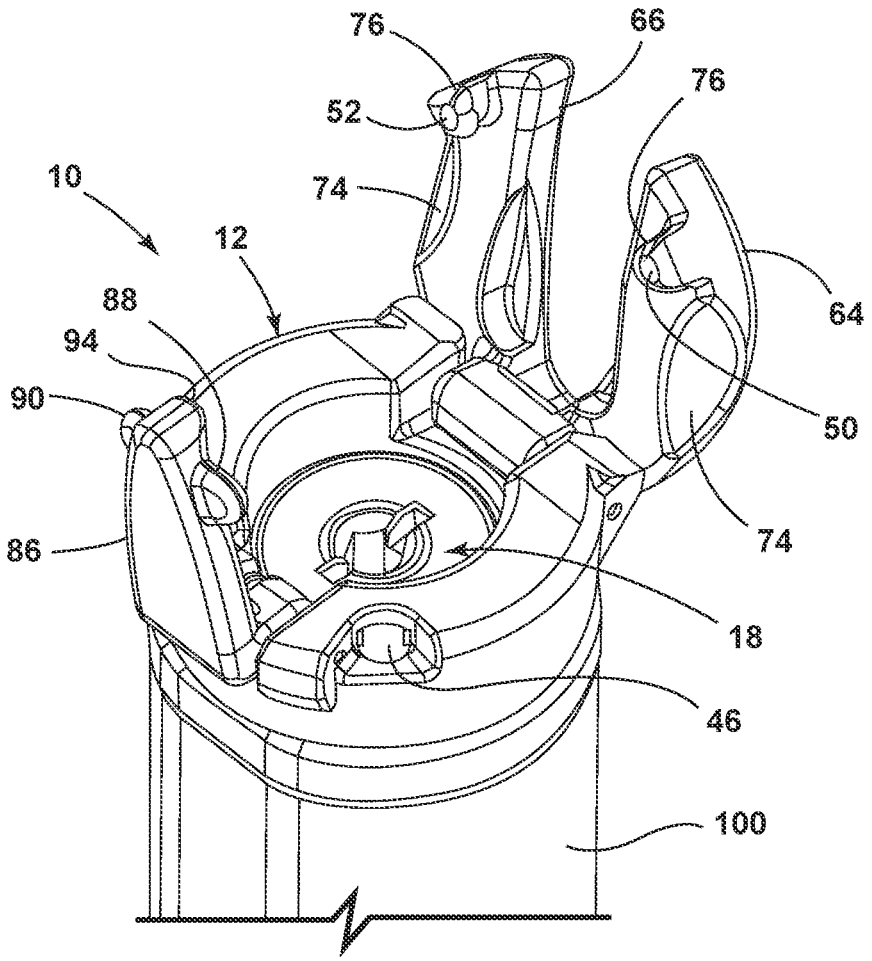
FIG. 4 depicts the golf ball retriever of FIG. 1 in the fully open position.
Figure 5:
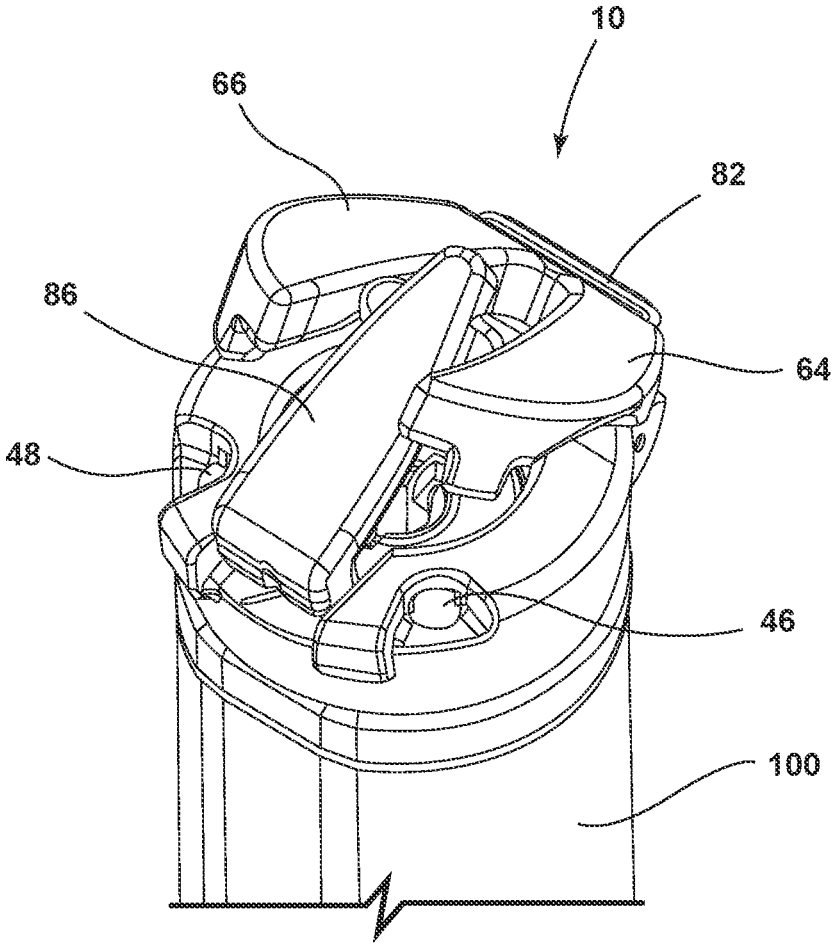
FIG. 5 depicts the golf ball retriever of FIG. 1 in a partially closed position.
Figure 6:
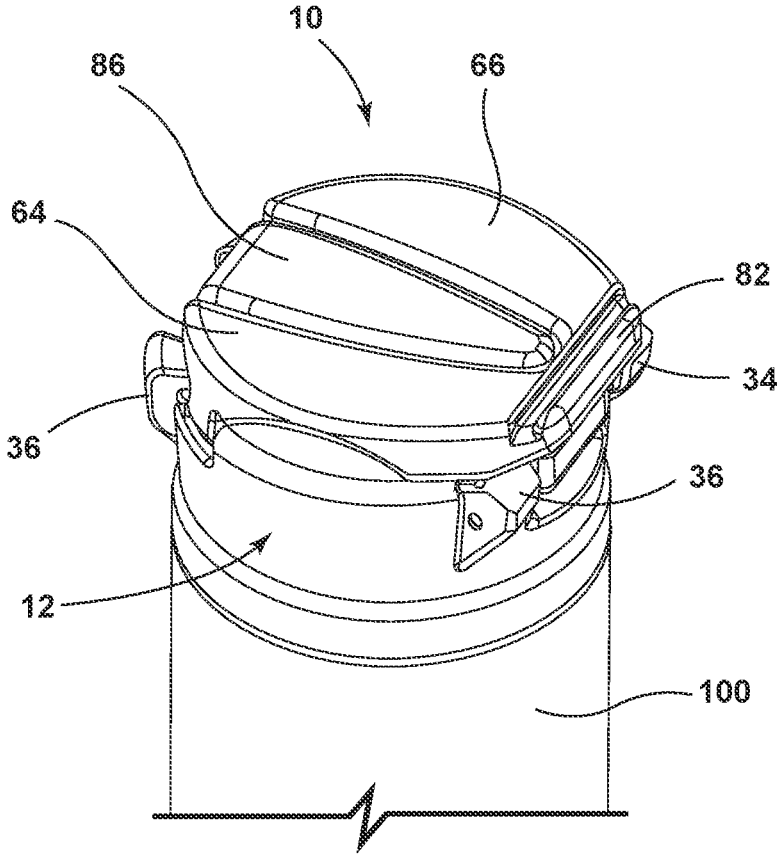
FIG. 6 depicts the golf ball retriever of FIG. 1 in the fully closed position.

With the first and second folding arms 14 in the fully deployed position as shown in FIG. 3, the user can align the central opening 56 of the base 12 with the threaded port 102 in the putter grip 100. The user can then thread the grip cap 18 into the threaded port 102, securing the golf ball retriever 10 to the putter grip 100. The first and second folding arms 14, 16 can be returned to the stowed position by folding the second folding arm 16 and thereafter folding the first folding arm 14. The retention latches 76 mechanically and magnetically secure the first folding arm 14 to the base 12. Because the second folding arm 16 includes first and second lateral protrusions 88, 90 that underlie the first folding arm 14, the first folding arm 14 maintains the second folding arm 16 in the stowed position, generally shown in FIG. 6.

Figure 7:
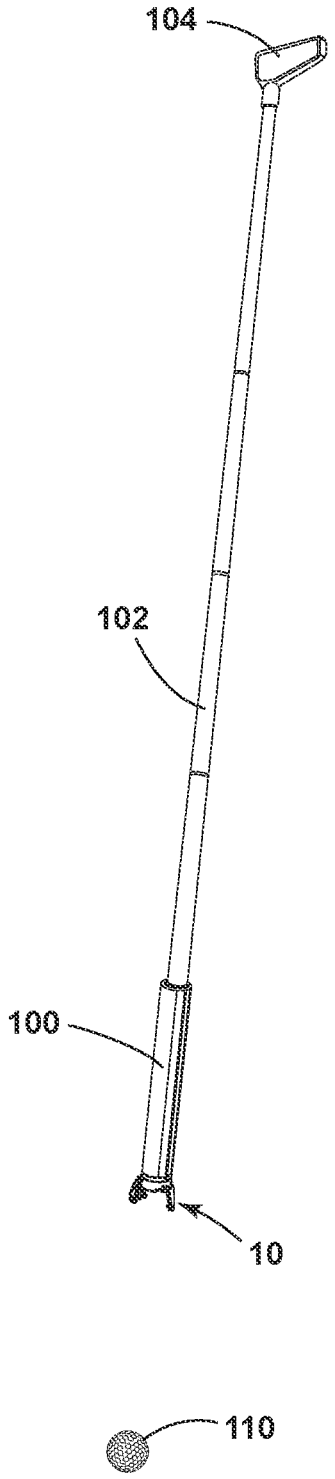
FIG. 7 depicts the golf ball retriever in the process of retrieving a golf ball.
Figure 8:
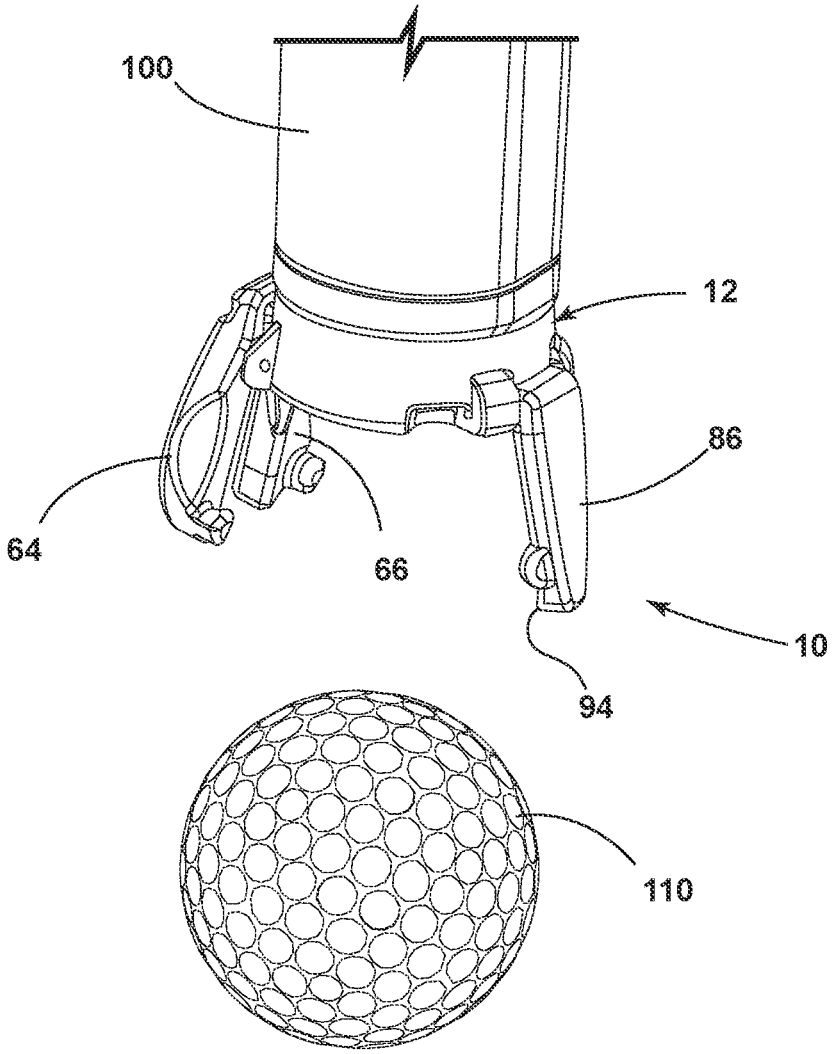
FIG. 8 is a close-up view of the golf ball retriever of FIG. 7.
Figure 9:
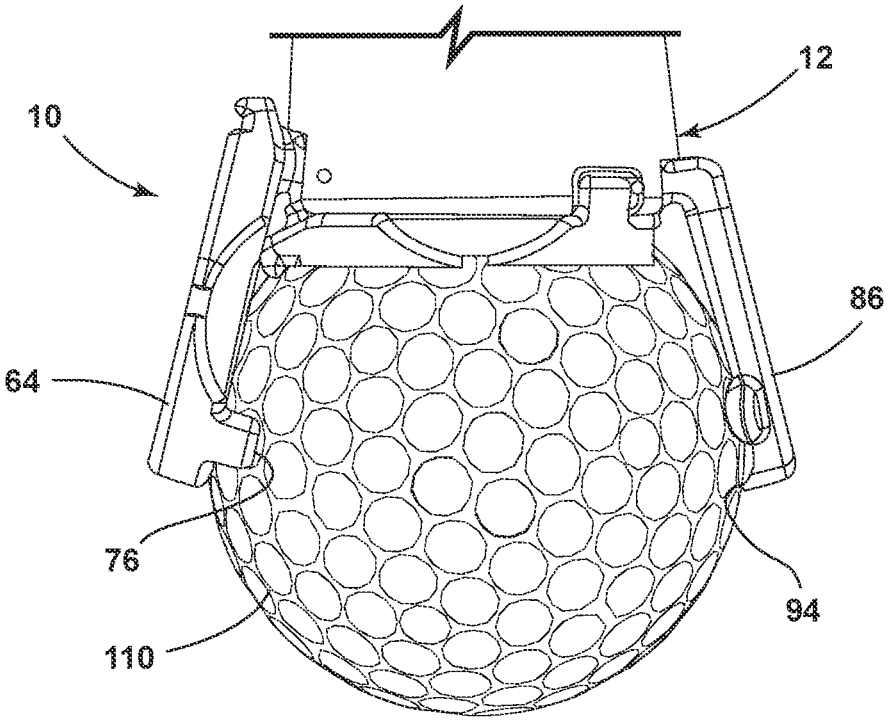
FIG. 9 is a close-up view of the golf ball retriever of FIG. 7 grasping a golf ball.

To recover a golf ball, the user deploys the folding arms 14, 16 in the manner discussed above. The user can either depress the cantilevered edge 82 on the first folding arm 14 or grip the concave recess 74 on either side of the first folding arm 14 to pivot the first folding arm 14 to an upright position. Once the first folding arm 14 rotates free of the second folding arm 16, the second folding arm 16 springs upright in response to the spring force of the torsion spring 84. In this fully deployed position, each folding arm 14, 16 is at its maximum range of motion, thereby forming a claw-like pocket. The putter (comprising a grip 100, a shaft 102, and a head 104) can be inverted as shown in FIGS. 7-8 and moved toward the golf ball 110. The user then lowers the golf ball retriever 10 onto the golf ball 110 as shown in FIG. 9, causing the folding arms 14, 16 to deflect slightly around the golf ball 110 until the retention latches 76 of the first folding arm 14 and the sloped projection 94 of the second folding arm 16 mechanically grasp the golf ball 110.

Figure 10:
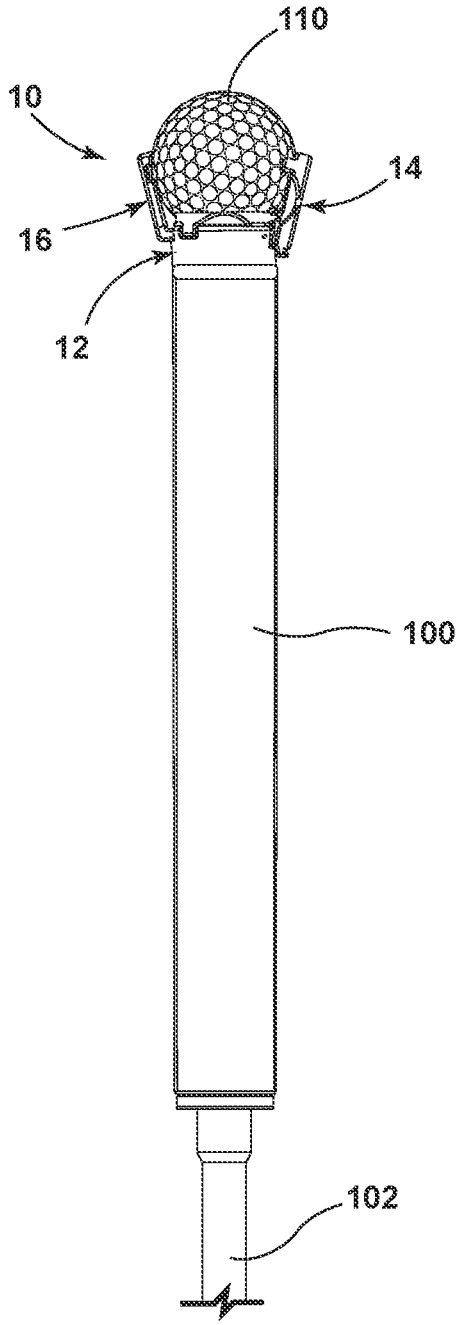
FIG. 10 depicts the golf ball retriever of FIG. 7 as having grasped a golf ball.

Once the golf ball 110 is secured in the pocket of the golf ball retriever 10, the user returns the golf club to the upright position as shown in FIG. 10 and manually removes the golf ball 110. The user then folds the second folding arm 16 against the base 12 and thereafter folds the first folding arm 14 until the retention latches 76 mechanically and magnetically secure the first folding arm 14 to the base 12. Because the second folding arm 16 includes first and second lateral protrusions 88, 90 that underlie the first folding arm 14, the first folding arm 14 maintains the second folding arm 16 in the stowed position. The putter can then be returned to a golf bag or used in the normal course of play as desired by the user.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular.

The invention claimed is:

1. A golf ball retriever for attachment to a threaded opening in a putter grip, the golf ball retriever comprising:

a base including a sidewall and an annular flange, the sidewall including a first hinge portion opposite of a second hinge portion, the annular flange extending radially inward from the sidewall and encircling a central aperture extending through the base;

a first folding arm rotatably joined to the first hinge portion of the sidewall via a first hinge pin;

a second folding arm rotatably joined to the second hinge portion of the sidewall via a second hinge pin; and a grip cap including a head and a shank, the head including a tool opening, the shank being sized to extend through the central aperture and into a threaded opening in a putter grip, the head including an outer diameter that is less than an inner diameter of the sidewall;

wherein the first folding arm and the second folding arm are disposed opposite of each other to grasp a golf ball when in a deployed position, and wherein the first folding arm and the second folding arm are rotatable to a stowed position in which a portion of the first folding arm overlies a portion of the second folding arm.

2. The golf ball retriever of claim 1, further including a torsion spring to bias the first folding arm or the second folding arm in the deployed position.

3. The golf ball retriever of claim 1, wherein the annular flange defines an inner diameter that is less than an outer diameter of the head of the grip cap, such that the head of the grip cap overlies the annular flange to secure the base to the putter grip.

4. The golf ball retriever of claim 1, wherein:

the first folding arm includes first and second arm segments, and the second folding arm includes a third arm segment, and the third arm segment is disposed between the first and second arm segments when the first and second folding arms are in the stowed position.

5. The golf ball retriever of claim 4, wherein the first and second arm segments including first and second ferromagnetic elements that are magnetically attracted to first and second magnets in the sidewall for maintaining the first folding arm in the stowed position.

6. The golf ball retriever of claim 4, wherein the sidewall includes first and second ferromagnetic elements that are magnetically attracted to first and second magnets in the first and second arm segments for maintaining the first folding arm in the stowed position.

7. The golf ball retriever of claim 4, wherein the sidewall includes first and second magnets that are magnetically attracted to third and fourth magnets in the first and second arm segments for maintaining the first folding arm in the stowed position.

8. The golf ball retriever of claim 4, wherein each of the first and second arm segments includes a planar upper surface, a planar bottom surface, and curved side surface therebetween.

9. The golf ball retriever of claim 8, wherein each of the first and second arm segments include a concave recess interconnecting the curved side surface and the planar bottom surface.

10. The golf ball retriever of claim 4, wherein the third arm segment includes first and second lateral protrusions that underlie the first and second arm segments when the first folding arm and the second folding arm are in the stowed position.

11. A golf ball retriever system comprising:

a golf grip including a distal end, a proximal end, and an elongated handle therebetween, the golf grip including an axial opening for a golf club shaft at the distal end and including an internally threaded opening at the proximal end opposite of the distal end;

a golf ball retriever joined to the proximal end of the golf grip, wherein the golf ball retriever includes:

a base including a sidewall and an annular flange, the sidewall including a first hinge portion opposite of a second hinge portion, the annular flange extending radially inward from the sidewall and encircling a central aperture extending through the base;

a first folding arm rotatably joined to the first hinge portion of the sidewall via a first hinge pin;

a second folding arm rotatably joined to the second hinge portion of the sidewall via a second hinge pin; and a grip cap including an externally threaded shank, a head that is wider than the shank, and a tool opening in the head;

wherein the first folding arm and the second folding arm are disposed opposite of each other to grasp a golf ball when in the deployed position, and wherein the first folding arm and the second folding arm are rotatable to a stowed position in which a portion of the first folding arm overlies a portion of the second folding arm.

12. The system claim 11, further including a torsion spring to bias the first folding arm or the second folding arm in the deployed position.

13. The system of claim 11, wherein the annular flange defines an inner diameter that is less than an outer diameter of the head of the grip cap, such that the head of the grip cap overlies the annular flange to secure the base to the putter grip.

14. The system of claim 11, wherein:

the first folding arm includes first and second arm segments, and the second folding arm includes a third arm segment, and the third arm segment is disposed between the first and second arm segments when the first and second folding arms are in the stowed position.

15. The system of claim 14, wherein the first and second arm segments including first and second ferromagnetic elements that are magnetically attracted to first and second magnets in the sidewall for maintaining the first folding arm in the stowed position.

16. The system of claim 14, wherein the sidewall includes first and second ferromagnetic elements that are magnetically attracted to first and second magnets in the first and second arm segments for maintaining the first folding arm in the stowed position.

17. The system of claim 14, wherein the sidewall includes first and second magnets that are magnetically attracted to third and fourth magnets in the first and second arm segments for maintaining the first folding arm in the stowed position.

18. The system of claim 14, wherein each of the first and second arm segments includes a planar upper surface, a planar bottom surface, and curved side surface therebetween.

19. The system of claim 18, wherein each of the first and second arm segments includes a concave recess interconnecting the curved side surface and the planar bottom surface.

20. The system of claim 14, wherein the third arm segment includes first and second lateral protrusions that underlie the first and second arm segments when the first folding arm and the second folding arm are in the stowed position.

21. The system of claim 14, wherein the third arm segment terminates at a sloped protrusion for grasping a golf ball.

* * * * *